US008221517B2

(12) United States Patent
Mirchandani et al.

(10) Patent No.: US 8,221,517 B2
(45) Date of Patent: Jul. 17, 2012

(54) CEMENTED CARBIDE—METALLIC ALLOY COMPOSITES

(75) Inventors: Prakash K. Mirchandani, Houston, TX (US); Morris E. Chandler, Santa Fe, TX (US); Eric W. Olsen, Cypress, TX (US)

(73) Assignee: TDY Industries, LLC, Pittsburgh, PA (US)

( * ) Notice: Subject to any disclaimer, the term of this patent is extended or adjusted under 35 U.S.C. 154(b) by 400 days.

(21) Appl. No.: 12/476,738

(22) Filed: Jun. 2, 2009

(65) Prior Publication Data

US 2009/0293672 A1 Dec. 3, 2009

Related U.S. Application Data

(60) Provisional application No. 61/057,885, filed on Jun. 2, 2008.

(51) Int. Cl.
*B22F 9/00* (2006.01)

(52) U.S. Cl. ..... 75/246; 75/247

(58) Field of Classification Search ..... 75/246, 75/247

See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,240,840 | A | 5/1941 | Fischer |
| 2,246,237 | A | 6/1941 | Benninghoff |
| 2,283,280 | A | 5/1942 | Nell |
| 2,299,207 | A | 10/1942 | Bevillard |
| 2,351,827 | A | 6/1944 | McAllister |

(Continued)

FOREIGN PATENT DOCUMENTS

| | | |
|---|---|---|
| AU | 695583 | 2/1998 |

(Continued)

OTHER PUBLICATIONS

ProKon Version 8.6 by The Calculation Companion. Properties for W, Ti, Mo, Co, Ni, and Fe. Copyright 1997-1998.*

(Continued)

*Primary Examiner* — George Wyszomierski
*Assistant Examiner* — Tima M McGuthry Banks
(74) *Attorney, Agent, or Firm* — K & L Gates LLP; Patrick J. Viccaro; John E. Grosselin, III

(57) ABSTRACT

A macroscopic composite sintered powder metal article including a first region including cemented hard particles, for example, cemented carbide. The article includes a second region including one of a metal and a metallic alloy selected from the group consisting of a steel, nickel, a nickel alloy, titanium, a titanium alloy, molybdenum, a molybdenum alloy, cobalt, a cobalt alloy, tungsten, and a tungsten alloy. The first region is metallurgically bonded to the second region, and the second region has a thickness of greater than 100 microns. A method of making a macroscopic composite sintered powder metal article is also disclosed, herein. The method includes co-press and sintering a first metal powder including hard particles and a powder binder and a second metal powder including the metal or metal alloy.

16 Claims, 2 Drawing Sheets

U.S. PATENT DOCUMENTS

| | | | |
|---|---|---|---|
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |
| 3,093,850 | A | 6/1963 | Kelso |
| 3,368,881 | A | 2/1968 | Abkowitz et al. |
| 3,471,921 | A | 10/1969 | Feenstra |
| 3,490,901 | A | 1/1970 | Hachisuka et al. |
| 3,581,835 | A | 6/1971 | Stebley |
| 3,629,887 | A | 12/1971 | Urbanic |
| 3,660,050 | A | 5/1972 | Iler et al. |
| 3,757,879 | A | 9/1973 | Wilder et al. |
| 3,776,655 | A | 12/1973 | Urbanic |
| 3,782,848 | A | 1/1974 | Pfeifer |
| 3,806,270 | A | 4/1974 | Tanner et al. |
| 3,812,548 | A | 5/1974 | Theuerkaue |
| RE28,645 | E | 12/1975 | Aoki et al. |
| 3,942,954 | A | 3/1976 | Frehn |
| 3,987,859 | A | 10/1976 | Lichte |
| 4,009,027 | A | 2/1977 | Naidich et al. |
| 4,017,480 | A | 4/1977 | Baum |
| 4,047,828 | A | 9/1977 | Makely |
| 4,094,709 | A | 6/1978 | Rozmus |
| 4,097,180 | A | 6/1978 | Kwieraga |
| 4,097,275 | A | 6/1978 | Horvath |
| 4,106,382 | A | 8/1978 | Salje et al. |
| 4,126,652 | A | 11/1978 | Oohara et al. |
| 4,128,136 | A | 12/1978 | Generoux |
| 4,170,499 | A | 10/1979 | Thomas et al. |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,270,952 | A | 6/1981 | Kobayashi |
| 4,277,106 | A | 7/1981 | Sahley |
| 4,306,139 | A | 12/1981 | Shinozaki et al. |
| 4,311,490 | A | 1/1982 | Bovenkerk et al. |
| 4,325,994 | A | 4/1982 | Kitashima et al. |
| 4,327,156 | A | 4/1982 | Dillon et al. |
| 4,340,327 | A | 7/1982 | Martins |
| 4,341,557 | A | 7/1982 | Lizenby |
| 4,396,321 | A | 8/1983 | Holmes |
| 4,398,952 | A | 8/1983 | Drake |
| 4,478,297 | A | 10/1984 | Radtke |
| 4,499,048 | A | 2/1985 | Hanejko |
| 4,499,795 | A | 2/1985 | Radtke |
| 4,526,748 | A | 7/1985 | Rozmus |
| 4,547,104 | A | 10/1985 | Holmes |
| 4,547,337 | A | 10/1985 | Rozmus |
| 4,550,532 | A | 11/1985 | Fletcher, Jr. et al. |
| 4,552,232 | A | 11/1985 | Frear |
| 4,553,615 | A | 11/1985 | Grainger |
| 4,554,130 | A | 11/1985 | Ecer |
| 4,562,990 | A | 1/1986 | Rose |
| 4,574,011 | A | 3/1986 | Bonjour et al. |
| 4,587,174 | A | 5/1986 | Yoshimura et al. |
| 4,592,685 | A | 6/1986 | Beere |
| 4,596,694 | A | 6/1986 | Rozmus |
| 4,597,730 | A | 7/1986 | Rozmus |
| 4,604,106 | A | 8/1986 | Hall |
| 4,605,343 | A | 8/1986 | Hibbs, Jr. et al. |
| 4,609,577 | A | 9/1986 | Long |
| 4,630,693 | A | 12/1986 | Goodfellow |
| 4,642,003 | A | 2/1987 | Yoshimura |
| 4,649,086 | A | 3/1987 | Johnson |
| 4,656,002 | A | 4/1987 | Lizenby et al. |
| 4,662,461 | A | 5/1987 | Garrett |
| 4,667,756 | A | 5/1987 | King et al. |
| 4,686,080 | A | 8/1987 | Hara et al. |
| 4,686,156 | A | 8/1987 | Baldoni, II et al. |
| 4,694,919 | A | 9/1987 | Barr |
| 4,708,542 | A | 11/1987 | Emanuelli |
| 4,722,405 | A | 2/1988 | Langford |
| 4,729,789 | A | 3/1988 | Ide et al. |
| 4,734,339 | A | 3/1988 | Schachner et al. |
| 4,743,515 | A | 5/1988 | Fischer et al. |
| 4,744,943 | A | 5/1988 | Timm |
| 4,749,053 | A | 6/1988 | Hollingshead |
| 4,752,159 | A | 6/1988 | Howlett |
| 4,752,164 | A | 6/1988 | Leonard, Jr. |
| 4,779,440 | A | 10/1988 | Cleve et al. |
| 4,809,903 | A | 3/1989 | Eylon et al. |
| 4,813,823 | A | 3/1989 | Bieneck |
| 4,838,366 | A | 6/1989 | Jones |
| 4,861,350 | A | 8/1989 | Phaal et al. |
| 4,871,377 | A | 10/1989 | Frushour |
| 4,881,431 | A | 11/1989 | Bieneck |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,956,012 | A | 9/1990 | Jacobs et al. |
| 4,968,348 | A | 11/1990 | Abkowitz et al. |
| 4,971,485 | A | 11/1990 | Nomura et al. |
| 4,991,670 | A | 2/1991 | Fuller et al. |
| 5,000,273 | A | 3/1991 | Horton et al. |
| 5,030,598 | A | 7/1991 | Hsieh |
| 5,032,352 | A | 7/1991 | Meeks et al. |
| 5,041,261 | A | 8/1991 | Buljan et al. |
| 5,049,450 | A | 9/1991 | Dorfman et al. |
| RE33,753 | E | 11/1991 | Vacchiano et al. |
| 5,067,860 | A | 11/1991 | Kobayashi et al. |
| 5,090,491 | A | 2/1992 | Tibbitts et al. |
| 5,092,412 | A | 3/1992 | Walk |
| 5,094,571 | A | 3/1992 | Ekerot |
| 5,098,232 | A | 3/1992 | Benson |
| 5,110,687 | A | 5/1992 | Abe et al. |
| 5,112,162 | A | 5/1992 | Hartford et al. |
| 5,112,168 | A | 5/1992 | Glimpel |
| 5,116,659 | A | 5/1992 | Glatzle et al. |
| 5,126,206 | A | 6/1992 | Garg et al. |
| 5,127,776 | A | 7/1992 | Glimpel |
| 5,161,898 | A | 11/1992 | Drake |
| 5,174,700 | A | 12/1992 | Sgarbi et al. |
| 5,179,772 | A | 1/1993 | Braun et al. |
| 5,186,739 | A | 2/1993 | Isobe et al. |
| 5,203,513 | A | 4/1993 | Keller et al. |
| 5,203,932 | A | 4/1993 | Kato et al. |
| 5,232,522 | A | 8/1993 | Doktycz et al. |
| 5,266,415 | A | 11/1993 | Newkirk et al. |
| 5,273,380 | A | 12/1993 | Musacchia |
| 5,281,260 | A | 1/1994 | Kumar et al. |
| 5,286,685 | A | 2/1994 | Schoennahl et al. |
| 5,305,840 | A | 4/1994 | Liang et al. |
| 5,311,958 | A | 5/1994 | Isbell et al. |
| 5,326,196 | A | 7/1994 | Noll |
| 5,333,520 | A | 8/1994 | Fischer et al. |
| 5,348,806 | A | 9/1994 | Kojo et al. |
| 5,359,772 | A | 11/1994 | Carlsson et al. |
| 5,373,907 | A | 12/1994 | Weaver |
| 5,376,329 | A | 12/1994 | Morgan et al. |
| 5,423,899 | A | 6/1995 | Krall et al. |
| 5,433,280 | A | 7/1995 | Smith |
| 5,438,858 | A | 8/1995 | Friedrichs |
| 5,443,337 | A | 8/1995 | Katayama |
| 5,452,771 | A | 9/1995 | Blackman et al. |
| 5,467,669 | A | 11/1995 | Stroud |
| 5,479,997 | A | 1/1996 | Scott et al. |
| 5,480,272 | A | 1/1996 | Jorgensen et al. |
| 5,482,670 | A | 1/1996 | Hong |
| 5,484,468 | A | 1/1996 | Östlund et al. |
| 5,487,626 | A | 1/1996 | Von Holst et al. |
| 5,496,137 | A | 3/1996 | Ochayon et al. |
| 5,505,748 | A | 4/1996 | Tank et al. |
| 5,506,055 | A | 4/1996 | Dorfman et al. |
| 5,518,077 | A | 5/1996 | Blackman et al. |
| 5,525,134 | A | 6/1996 | Mehrotra et al. |
| 5,541,006 | A | 7/1996 | Conley |
| 5,543,235 | A | 8/1996 | Mirchandani et al. |
| 5,544,550 | A | 8/1996 | Smith |
| 5,560,440 | A | 10/1996 | Tibbitts |
| 5,570,978 | A | 11/1996 | Rees et al. |
| 5,580,666 | A | 12/1996 | Dubensky et al. |

5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,635,247 A 6/1997 Ruppi
5,641,251 A 6/1997 Leins et al.
5,641,921 A 6/1997 Dennis et al.
5,662,183 A 9/1997 Fang
5,665,431 A 9/1997 Narasimhan
5,666,864 A 9/1997 Tibbitts
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,718,948 A 2/1998 Ederyd et al.
5,732,783 A 3/1998 Truax et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Günter et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,792,403 A 8/1998 Massa et al.
5,806,934 A 9/1998 Massa et al.
5,830,256 A 11/1998 Northrop et al.
5,851,094 A 12/1998 Stand et al.
5,856,626 A 1/1999 Fischer et al.
5,863,640 A 1/1999 Ljungberg et al.
5,865,571 A 2/1999 Tankala et al.
5,873,684 A 2/1999 Flolo
5,880,382 A * 3/1999 Fang et al. ..... 75/236
5,890,852 A 4/1999 Gress
5,897,830 A 4/1999 Abkowitz et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Günter et al.
6,086,980 A 7/2000 Foster et al.
6,089,123 A 7/2000 Chow et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,247 B1 4/2001 Leverenz et al.
6,214,287 B1 4/2001 Waldenström
6,217,992 B1 4/2001 Grab
6,220,117 B1 4/2001 Butcher
6,227,188 B1 5/2001 Tankala et al.
6,228,139 B1 5/2001 Oskarsson
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,499,917 B1 12/2002 Parker et al.
6,499,920 B2 12/2002 Sawabe
6,500,226 B1 12/2002 Dennis
6,502,623 B1 1/2003 Schmitt
6,511,265 B1 * 1/2003 Mirchandani et al. ..... 407/53
6,544,308 B2 4/2003 Griffin et al.
6,551,035 B1 4/2003 Bruhn et al.
6,554,548 B1 4/2003 Grab et al.
6,562,462 B2 5/2003 Griffin et al.
6,576,182 B1 6/2003 Ravagni et al.
6,585,064 B2 7/2003 Griffin et al.
6,589,640 B2 7/2003 Griffin et al.
6,599,467 B1 7/2003 Yamaguchi et al.
6,607,693 B1 8/2003 Saito et al.
6,620,375 B1 9/2003 Tank et al.
6,638,609 B2 10/2003 Nordgren et al.
6,655,481 B2 12/2003 Findley et al.
6,676,863 B2 1/2004 Christiaens et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,723,389 B2 4/2004 Kobayashi et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,884,496 B2 4/2005 Westphal et al.
6,892,793 B2 5/2005 Liu et al.
6,899,495 B2 5/2005 Hansson et al.
6,918,942 B2 7/2005 Hatta et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,044,243 B2 5/2006 Kembaiyan et al.
7,048,081 B2 5/2006 Smith et al.
7,070,666 B2 7/2006 Druschitz et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Blomstedt et al.
7,128,773 B2 10/2006 Liang et al.
7,147,413 B2 12/2006 Henderer et al.
7,175,404 B2 2/2007 Kondo et al.
7,207,750 B2 4/2007 Annanolli et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.

| | | | | |
|---|---|---|---|---|
| 7,267,543 | B2 | 9/2007 | Freidhoff et al. | |
| 7,270,679 | B2 | 9/2007 | Istephanous et al. | |
| 7,296,497 | B2 | 11/2007 | Kugelberg et al. | |
| 7,381,283 | B2 | 6/2008 | Lee et al. | |
| 7,384,413 | B2 | 6/2008 | Gross et al. | |
| 7,384,443 | B2 | 6/2008 | Mirchandani et al. | |
| 7,410,610 | B2 | 8/2008 | Woodfield et al. | |
| 7,497,396 | B2 | 3/2009 | Splinter et al. | |
| 7,513,320 | B2 | 4/2009 | Mirchandani et al. | |
| 7,625,157 | B2 | 12/2009 | Prichard et al. | |
| 7,687,156 | B2 | 3/2010 | Fang | |
| 7,846,551 | B2 | 12/2010 | Fang et al. | |
| 8,007,922 | B2 * | 8/2011 | Mirchandani et al. | 428/548 |
| 8,025,112 | B2 | 9/2011 | Mirchandani et al. | |
| 2002/0004105 | A1 | 1/2002 | Kunze et al. | |
| 2003/0010409 | A1 | 1/2003 | Kunze et al. | |
| 2003/0041922 | A1 | 3/2003 | Hirose et al. | |
| 2003/0219605 | A1 | 11/2003 | Molian et al. | |
| 2004/0013558 | A1 | 1/2004 | Kondoh et al. | |
| 2004/0105730 | A1 | 6/2004 | Nakajima | |
| 2004/0228695 | A1 | 11/2004 | Clauson | |
| 2004/0234820 | A1 | 11/2004 | Majagi | |
| 2004/0245022 | A1 | 12/2004 | Izaguirre et al. | |
| 2004/0245024 | A1 | 12/2004 | Kembaiyan | |
| 2005/0008524 | A1 | 1/2005 | Testani | |
| 2005/0025928 | A1 | 2/2005 | Annanolli et al. | |
| 2005/0084407 | A1 | 4/2005 | Myrick | |
| 2005/0103404 | A1 | 5/2005 | Hsieh et al. | |
| 2005/0117984 | A1 | 6/2005 | Eason et al. | |
| 2005/0126334 | A1 * | 6/2005 | Mirchandani | 75/240 |
| 2005/0194073 | A1 | 9/2005 | Hamano et al. | |
| 2005/0211475 | A1 | 9/2005 | Mirchandani et al. | |
| 2005/0247491 | A1 | 11/2005 | Mirchandani et al. | |
| 2005/0268746 | A1 | 12/2005 | Abkowitz et al. | |
| 2006/0016521 | A1 | 1/2006 | Hanusiak et al. | |
| 2006/0032677 | A1 | 2/2006 | Azar et al. | |
| 2006/0043648 | A1 | 3/2006 | Takeuchi et al. | |
| 2006/0060392 | A1 | 3/2006 | Eyre | |
| 2006/0286410 | A1 | 12/2006 | Ahigren et al. | |
| 2006/0288820 | A1 | 12/2006 | Mirchandani et al. | |
| 2007/0042217 | A1 | 2/2007 | Fang et al. | |
| 2007/0082229 | A1 | 4/2007 | Mirchandani et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0108650 | A1 | 5/2007 | Mirchandani et al. | |
| 2007/0126334 | A1 | 6/2007 | Nakamura et al. | |
| 2007/0163679 | A1 | 7/2007 | Fujisawa et al. | |
| 2007/0193782 | A1 | 8/2007 | Fang et al. | |
| 2007/0251732 | A1 | 11/2007 | Mirchandani et al. | |
| 2008/0011519 | A1 | 1/2008 | Smith et al. | |
| 2008/0101977 | A1 | 5/2008 | Eason et al. | |
| 2008/0145686 | A1 | 6/2008 | Michandani et al. | |
| 2008/0163723 | A1 | 7/2008 | Mirchandani et al. | |
| 2008/0196318 | A1 | 8/2008 | Bost et al. | |
| 2008/0302576 | A1 | 12/2008 | Michandani et al. | |
| 2009/0041612 | A1 | 2/2009 | Fang et al. | |
| 2009/0136308 | A1 | 5/2009 | Newitt | |
| 2009/0180915 | A1 | 7/2009 | Mirchandani et al. | |
| 2010/0044114 | A1 | 2/2010 | Mirchandani et al. | |
| 2010/0044115 | A1 | 2/2010 | Mirchandani et al. | |
| 2010/0278603 | A1 | 11/2010 | Fang et al. | |
| 2010/0290849 | A1 | 11/2010 | Mirchandani et al. | |
| 2010/0303566 | A1 | 12/2010 | Fang et al. | |
| 2011/0011965 | A1 | 1/2011 | Mirchandani et al. | |

FOREIGN PATENT DOCUMENTS

| | | | |
|---|---|---|---|
| CA | 2212197 | C | 10/2000 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1065021 | A1 | 1/2001 |
| EP | 1077783 | B1 | 2/2001 |
| EP | 1106706 | A1 | 6/2001 |
| EP | 0759480 | B1 | 1/2002 |
| EP | 1244531 | B1 | 10/2004 |
| EP | 1686193 | A2 | 8/2006 |
| EP | 1198609 | B2 | 10/2007 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2324752 | A | 11/1998 |
| GB | 2352727 | A | 2/2001 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 61-243103 | A | 10/1986 |
| JP | 62-34710 | A | 2/1987 |
| JP | 62-063005 | A | 3/1987 |
| JP | 62-218010 | A | 9/1987 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 5-50314 | A | 3/1993 |
| JP | 5-92329 | A | 4/1993 |
| JP | H05-64288 | U | 8/1993 |
| JP | H03-119090 | U | 6/1995 |
| JP | 8-120308 | A | 5/1996 |
| JP | H8-209284 | | 8/1996 |
| JP | 10219385 | A | 8/1998 |
| JP | 11-300516 | A | 11/1999 |
| JP | 2000-355725 | A | 12/2000 |
| JP | 2002-097885 | A | 4/2002 |
| JP | 2002-166326 | A | 6/2002 |
| JP | 02254144 | A | 9/2002 |
| JP | 2002-317596 | A | 10/2002 |
| JP | 2003-306739 | A | 10/2003 |
| JP | 2004-160591 | A | 6/2004 |
| JP | 2004-181604 | A | 7/2004 |
| JP | 2004-190034 | A | 7/2004 |
| JP | 2005-111581 | A | 4/2005 |
| RU | 2135328 | C1 | 8/1999 |
| SU | 1269922 | A | 11/1986 |
| SU | 1292917 | A1 | 2/1987 |
| SU | 1350322 | | 11/1987 |
| WO | WO 92/05009 | A1 | 4/1992 |
| WO | WO 92/22390 | A1 | 12/1992 |
| WO | WO 98/28455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 00/73532 | A1 | 12/2000 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007/001870 | A2 | 1/2007 |
| WO | WO 2007/030707 | A1 | 3/2007 |
| WO | WO 2007/044791 | A1 | 4/2007 |
| WO | WO 2008/098636 | A1 | 8/2008 |
| WO | WO 2008/115703 | A1 | 9/2008 |
| WO | WO 2011/008439 | A2 | 1/2011 |

OTHER PUBLICATIONS

TIBTECH "Properties table of Stainless steel, Metals and other Conductive materials". http://www.tibtech.com/conductivity.php downloaded Aug. 19, 2011.*
MEMSnet, "Material: Tungsten Carbide (WC), bulk". http://www.memsnet.org/material/tungstencarbidebidewbulk/ Dowloaded Aug. 19, 2011.*
"The Thermal Conductivity of some common Materials and Gases". From the website "The Engineering ToolBox" http://www.engineeringtoolbox.com/thermal-conductivity-d_429.html downloaded Dec. 15, 2011.*
Advisory Action mailed Jun. 29, 2009 in U.S. Appl. No. 10/903,198.
ASM Materials Engineering Dictionary, J. R. Davis, Ed., ASM International, Fifth printing (Jan. 2006), p. 98.
Coyle, T.W. and A. Bahrami, "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547-552.
Gurland, J. *Quantitative Microscopy*, R.T. DeHoff and F.N. Rhines, eds., McGraw-Hill Book Company, New York, 1968, pp. 279-290.
Gurland, Joseph, "Application of Quantitative Microscopy to Cemented Carbides," Practical Applications of Quantitative Matellography, ASTM Special Technical Publication 839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook, vol. 16 Machining, "Tapping" (ASM International 1989), pp. 255-267.
Notice of Allowance issued on Jan. 27, 2009 in U.S. Appl. No. 11/116,752.
Notice of Allowance mailed Oct. 21, 2002 in U.S. Appl. No. 09/460,540.
Notice of Allowance issued on Nov. 30, 2009 in U.S. Appl. No. 11/206,368.
Notice of Allowance issued on Jan. 26, 2010 in U.S. Appl. No. 11/116,752.
Office Action (Advisory Action) mailed Mar. 15, 2002 in U.S. Appl. No. 09/460,540.
Office Action (final) mailed Dec. 1, 2001 in U.S. Appl. No. 09/460,540.
Office Action (non-final) mailed Jun. 1, 2001 in U.S. Appl. No. 09/460,540.
Office Action (non-final) mailed Jun. 18, 2002 in U.S. Appl. No. 09/460,540.
Office Action issued on Aug. 12, 2008 in U.S. Appl. No. 11/116,752.
Office Action issued on Jul. 9, 2009 in U.S. Appl. No. 11/116,752.
Office Action issued on Aug. 31, 2007 in U.S. Appl. No. 11/206,368.
Office Action issued on Feb. 28, 2008 in U.S. Appl. No. 11/206,368.
Office Action issued on Jan. 15, 2008 in U.S. Appl. No. 11/116,752.
Office Action issued on Jan. 16, 2007 in U.S. Appl. No. 11/013,842.
Office Action issued on Jan. 24, 2008 in U.S. Appl. No. 10/848,437.
Office Action issued on Jul. 16, 2008 in U.S. Appl. No. 11/013,842.
Office Action issued on Jul. 30, 2007 in U.S. Appl. No. 11/013,842.
Office Action mailed Apr. 30, 2009 in U.S. Appl. No. 11/206,368.
Office Action mailed Oct. 31, 2008 in U.S. Appl. No. 10/903,198.
Office Action mailed Apr. 17, 2009 in U.S. Appl. No. 10/903,198.
Peterman, Walter, "Heat-Sink Compound Protects the Unprotected," Welding Design and Fabrication, Sep. 2003, pp. 20-22.
Pre-Appeal Brief Conference Decision issued on May 14, 2008 in U.S. Appl. No. 10/848,437.
Pre-Appeal Conference Decision issued on Jun. 19, 2008 in U.S. Appl. No. 11/206,368.
Restriction Requirement issued on Sep. 8, 2006 in U.S. Appl. No. 10/848,437.
Sriram, et al., "Effect of Cerium Addition on Microstructures of Carbon-Alloyed Iron Aluminides," Bull. Mater. Sci., vol. 28, No. 6, Oct. 2005, pp. 547-554.
Tracey et al., "Development of Tungsten Carbide-Cobalt-Ruthenium Cutting Tools for Machining Steels" Proceedings Annual Microprogramming Workshop, vol. 14, 1981, pp. 281-292.
Underwood, *Quantitative Stereology*, pp. 23-108 (1970).
U.S. Appl. No. 12/464,607, filed May 12, 2009.
U.S. Appl. No. 12/502,277, filed Jul. 14, 2009.
Metals Handbook, vol. 16 Machining, "Cemented Carbides" (ASM International 1939), pp. 71-89.
Shi et al., "Composite Ductility—The Role of Reinforcement and Matrix", TMS Meeting, Las Vegas, NV, Feb. 12-16, 1995, 10 pages.
Vander Vort, "Introduction to Quantitative Metallography", Tech Notes, vol. 1, Issue 5, published by Buehler, Ltd. 1997, 6 pages.
You Tube, "The Story Behind Kennametal's Beyond Blast", dated Sep. 14, 2010, http://www.youtube.com/watch?v=8_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
Childs et al., "Metal Machining", 2000, Elsevier, p. 111.
Brookes, Kenneth J. A., "World Directory and Handbook of Hardmetals and Hard Materials", International Carbide Data, U.K. 1996, Sixth Edition, p. 42.
Firth Sterling grade chart, Allegheny Technologies; attached to Declaration of Prakash Mirchandani, Ph.D. as filed in U.S. Appl. No. 11/737,993 on Sep. 9, 2009.
Metals Handbook Desk Edition, definition of 'wear', 2nd Ed., J.R. Davis, Editor, ASM International 1998, p. 62.
McGraw-Hill Dictionary of Scientific and Technical Terms, 5th Edition, Sybil P. Parker, Editor in Chief, 1993, pp. 799, 800, 1933, and 2047.
Williams, Wendell S., "The Thermal Conductivity of Metallic Ceramics", JOM, Jun. 1998, pp. 62-66.
Brookes, Kenneth J. A., "World Directory and Handbook of Hardmetals and Hard Materials", International Carbide Data, U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27, 2011, 3 pages.
Shing et al., "The effect of ruthenium additions on hardness, toughness and grain size of WC-Co." Int. J. of Refractory Metals & Hard Materials, vol. 19, pp. 41-44. 2001.
Biernat, "Coating can greatly enhance carbide tool life and performance, but only if they stay in place," Cutting Tool Engineering, 47(2), Mar. 1995.
Brooks, World Dictionary and Handbook of Hardmetals and Hard Materials, International Carbide Data, Sixth edition, 1996, p. D194.
Tonshoff et al., "Surface treatment of cutting tool substrates," Int. J. Tools Manufacturing. 38(5-6), 1998, 469-476.
Bouzakis et al., "Improvement of PVD Coated Inserts Cutting Performance Through Appropriate Mechanical Treatments of Substrate and Coating Surface", Surface and Coatings Technology, 2001, 146-174; pp. 443-490.
Destefani, "Cutting tools 101. Coatings," Manufacturing Engineering, 129(4), 2002, 5 pages.
Santhanam, et al., "Comparison of the Steel-Milling Performance of Carbide Inserts with MTCVD and PVD TiCN Coatings", Int. J. of Refractory Metals & Hard Materials, vol. 14, 1996, pp. 31-40.
Wolfe et al., "The Role of Hard Coating in Carbide Milling Tools", J. Vacuum Science Technology, vol. 4, No. 6, Nov./Dec. 1986, pp. 2747-2754.
Quinto, "Mechanical Property and Structure Relationships in Hard Coatings for Cutting Tools", J. Vacuum Science Technology vol. 6, No. 3, May/Jun. 1988, pp. 2149-2157.
Office Action mailed Mar. 12, 2009 in U.S. Appl. No. 11/585,408.
Office Action mailed Sep. 22, 2009 in U.S. Appl. No. 11/585,408.
Office Action mailed Sep. 7, 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.

Restriction Requirement mailed Jul. 24, 2008 in U.S. Appl. No. 11/167,811.
Office Action mailed Oct. 21, 2008 in U.S. Appl. No. 11/167,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,811.
Advisory Action mailed May 11, 2011 in U.S. Appl. No. 11/167,811.
Office Action mailed Jul. 22, 2011 in U.S. Appl. No. 11/167,811.
Office Action mailed Mar. 19, 2009 in U.S. Appl. No. 11/737,993.
Office Action mailed Jun. 3, 2009 in U.S. Appl. No. 11/737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. No. 11/737,993.
Advisory Action Before the Filing of an Appeal Brief mailed Sep. 9, 2010 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Restriction Requirement mailed Sep. 17, 2010 in U.S. Appl. No. 12/397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed May 3, 2010 in U.S. Appl. No. 11/924,273.
Office Action maled Oct. 14, 2010 in U.S. Appl. No. 11/924,273.
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 2007 in U.S. Appl. No. 10/903,198.
Office Action mailed Sep. 26, 2007 in U.S. Appl. No. 10/903,198.
Offce Action mailed Jan. 16, 2008 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Oct. 13, 2011 in U.S. Appl. No. 12/179,999.
Office Action mailed Sep. 2, 2011 in U.S. Appl. No. 12/850,003.
Notice of Allowance mailed Nov. 15, 2011 in U.S. Appl. No. 12/850,003.
Office Action mailed Nov. 14, 2011 in U.S. Appl. No. 12/502,277.
U.S. Appl. No. 13/207,478, filed Aug. 11, 2011.
Office Action mailed Oct. 31, 2011 in U.S. Appl. No. 13/207,478.
Notice of Allowance mailed Nov. 26, 2008 in U.S. Appl. No. 11/013,842.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3, 2007 for U.S. Appl. No. 10/922,750.
Office Action mailed May 14, 2009 in U.S. Appl. No. 11/687,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2011 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16, 2011 in U.S. Appl. No. 12/196,815.
Notice of Allowance mailed Nov. 13, 2008 in U.S. Appl. No. 11/206,368.
US 4,966,627, 10/1990, Keshavan et al. (withdrawn)

* cited by examiner

CEMENTED CARBIDE—METALLIC ALLOY COMPOSITES

CROSS-REFERENCE TO RELATED APPLICATION

The present application claims priority under 35 U.S.C. §119(e) to U.S. Provisional Patent Application Ser. No. 61/057,885, filed Jun. 2, 2008.

FIELD OF TECHNOLOGY

The present disclosure relates to improved articles including cemented hard particles and methods of making such articles.

BACKGROUND

Materials composed of cemented hard particles are technologically and commercially important. Cemented hard particles include a discontinuous dispersed phase of hard metallic (i.e., metal-containing) and/or ceramic particles embedded in a continuous metallic binder phase. Many such materials possess unique combinations of abrasion and wear resistance, strength, and fracture toughness.

Terms used herein have the following meanings. "Strength" is the stress at which a material ruptures or fails. "Fracture toughness" is the ability of a material to absorb energy and deform plastically before fracturing. "Toughness" is proportional to the area under the stress-strain curve from the origin to the breaking point. See McGraw Hill Dictionary of Scientific and Technical Terms (5th ed. 1994). "Wear resistance" is the ability of a material to withstand damage to its surface. "Wear" generally involves progressive loss of material due to a relative motion between a material and a contacting surface or substance. See Metals Handbook Desk Edition (2d ed. 1998).

The dispersed hard particle phase typically includes grains of, for example, one or more of a carbide, a nitride, a boride, a silicide, an oxide, and solid solutions of any of these types of compounds. Hard particles commonly used in cemented hard particle materials are metal carbides such as tungsten carbide and, thus, these materials are often referred to generically as "cemented carbides." The continuous binder phase, which binds or "cements" the hard particles together, generally includes, for example, at least one of cobalt, cobalt alloy, nickel, nickel alloy, iron and iron alloy. Additionally, alloying elements such as, for example, chromium, molybdenum, ruthenium, boron, tungsten, tantalum, titanium, and niobium may be included in the binder phase to enhance particular properties. The various commercially available cemented carbide grades differ in terms of at least one property such as, for example, composition, grain size, or volume fractions of the discontinuous and/or continuous phases.

For certain applications parts formed from cemented hard particles may need to be attached to parts formed of different materials such as, for example, steels, nonferrous metallic alloys, and plastics. Techniques that have been used to attach such parts include metallurgical techniques such as, for example, brazing, welding, and soldering, and mechanical techniques such as, for example, press or shrink fitting, application of epoxy and other adhesives, and mating of mechanical features such as threaded coupling and keyway arrangements.

Problems are encountered when attaching cemented hard particle parts to parts formed of steels or nonferrous alloys using conventional metallurgical or mechanical techniques.

The difference in coefficient of thermal expansion (CTE) between cemented carbide materials and most steels (as well as most nonferrous alloys) is significant. For example, the CTE of steel ranges from about $10\times10^{-6}$ in/in/° K to $15\times10^{-6}$ in/in/° K, which is about twice the range of about $5\times10^{-6}$ in/in/° K to $7\times10^{-6}$ in/in/° K CTE for a cemented carbide. The CTE of certain nonferrous alloys exceeds that of steel, resulting in an even more significant CTE mismatch. If metallurgical bonding techniques such as brazing or welding are employed to attach a cemented carbide part to a steel part, for example, enormous stresses may develop at the interface between the parts during cooling due to differences in rates of part contraction. These stresses often result in the development of cracks at and near the interface of the parts. These defects weaken the bond between the cemented hard particle region and the metal or metallic region, and also the attached regions of the parts themselves.

In general, it is usually not practical to mechanically attach cemented hard particle parts to steel or other metallic parts using threads, keyways or other mechanical features because the fracture toughness of cemented carbides is low relative to steel and other metals and metallic alloys. Moreover, cemented carbides, for example, are highly notch-sensitive and susceptible to premature crack formation at sharp corners. Comers are difficult to avoid including in parts when designing mechanical features such as threads and keyways on the parts. Thus, the cemented hard particle parts can prematurely fracture in the areas incorporating the mechanical features.

The technique described in U.S. Pat. No. 5,359,772 to Carlsson et al. attempts to overcome certain difficulties encountered in forming composite articles having a cemented carbide region attached to a metal region. Carlsson teaches a technique of spin-casting iron onto pre-formed cemented carbide rings. Carlsson asserts that the technique forms a "metallurgical bond" between the iron and the cemented carbide. The composition of the cast iron in Carlsson must be carefully controlled such that a portion of the austenite forms bainite in order to relieve the stresses caused by differential shrinkage between the cemented carbide and the cast iron during cooling from the casting temperature. However, this transition occurs during a heat treating step after the composite is formed, to relieve stress that already exists. Thus, the bond formed between the cast iron and the cemented carbide in the method of Carlsson may already suffer from stress damage. Further, a bonding technique as described in Carlsson has limited utility and will only potentially be effective when using spin casting and cast iron, and would not be effective with other metals or metal alloys.

The difficulties associated with the attachment of cemented hard particle parts to parts of dissimilar materials, and particularly metallic parts, have posed substantial challenges to design engineers and have limited the applications for cemented hard particle parts. As such, there is a need for improved cemented hard particle-metallic and related materials, methods, and designs.

SUMMARY

One non-limiting embodiment according to the present disclosure is directed to a composite sintered powder metal article that includes a first region including cemented hard particles and a second region including at least one of a metal and a metallic alloy. The metal or metallic alloy is selected from a steel, nickel, a nickel alloy, titanium, a titanium alloy, molybdenum, a molybdenum alloy, cobalt, a cobalt alloy, tungsten, and a tungsten alloy. The first region is metallurgically bonded to the second region, and the second region has a thickness greater than 100 microns.

Another non-limiting embodiment according to the present disclosure is directed to a method of making a composite sintered powder metal article. The method includes providing a first powder in a first region of a mold, and providing a second powder in a second region of the mold, wherein the second powder contacts the first powder. The first powder includes hard particles and a powdered binder. The second powder includes at least one of a metal powder and a metallic alloy powder selected from a steel powder, a nickel powder, a nickel alloy powder, a molybdenum powder, a molybdenum alloy powder, a titanium powder, a titanium alloy powder, a cobalt powder, a cobalt alloy powder, a tungsten powder, and a tungsten alloy powder. The method further includes consolidating the first powder and the second powder in the mold to provide a green compact. The green compact is sintered to provide a composite sintered powder metal article including a first region metallurgically bonded to a second region. The first region includes a cemented hard particle material formed on sintering the first powder. The second region includes a metal or metallic alloy formed on sintering the second powder.

BRIEF DESCRIPTION OF THE FIGURES

Features and advantages of the subject matter described herein may be better understood by reference to the accompanying figures in which.

DETAILED DESCRIPTION

In the present description of non-limiting embodiments and in the claims, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description and the attached claims are approximations that may vary depending upon the desired properties one seeks to obtain in the subject matter described in the present disclosure. At the very least, and not as an attempt to limit the application of the doctrine of equivalents to the scope of the claims, each numerical parameter should at least be construed in light of the number of reported significant digits and by applying ordinary rounding techniques.

Figure 1A:
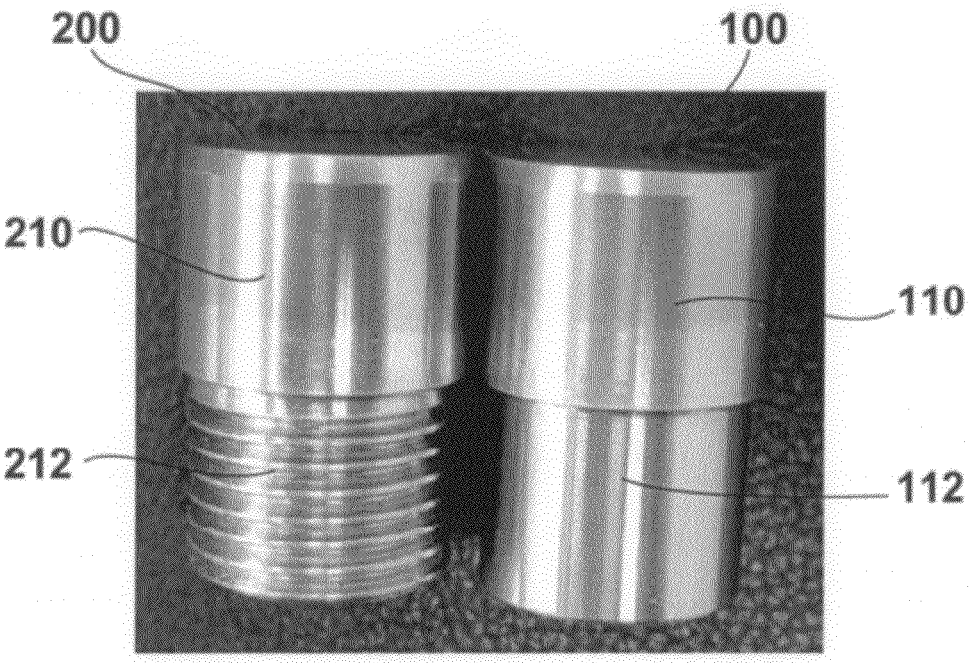
FIG. 1A illustrates non-limiting embodiments of composite sintered powder metal articles according to the present disclosure including a cemented carbide region metallurgically bonded to a nickel region, wherein the article depicted on the left includes threads machined into the nickel region.

Certain embodiments according to the present disclosure are directed to composite sintered powder metal articles. A composite article is an object that comprises at least two regions, each region composed of a different material. Composite sintered powder metal articles according to the present disclosure include at least a first region, which includes cemented hard particles, metallurgically bonded to a second region, which includes at least one of a metal and a metallic alloy. Two non-limiting examples of composite articles according to the present disclosure are shown in FIG. 1A. Sintered powder metal article 100 includes a first region in the form of a cemented carbide region 110 metallurgically bonded to a second region in the form of a nickel region 112. Sintered powder metal article 200 includes a first region in the form of a cemented carbide region 210 metallurgically bonded to a second region in the form of a threaded nickel region 212.

As it is known in the art sintered powder metal material is produced by pressing and sintering masses of metallurgical powders. In a conventional press-and-sinter process, a metallurgical powder blend is placed in a void of a mold and compressed to form a "green compact." The green compact is sintered, which densifies the compact and metallurgically bonds together the individual powder particles. In certain instances, the compact may be consolidated during sintering to full or near-full theoretical density.

In composite articles according to the present disclosure, the cemented hard particles of the first region are a composite including a discontinuous phase of hard particles dispersed in a continuous binder phase. The metal and/or metallic alloy included in the second region is one or more selected from a steel, nickel, a nickel alloy, titanium, a titanium alloy, molybdenum, a molybdenum alloy, cobalt, a cobalt alloy, tungsten, and a tungsten alloy. The two regions are formed from metallurgical powders that are pressed and sintered together. During sintering, a metallurgical bond forms between the first and second regions, for example, at the interface between the cemented hard particles in the first region and the metal and/or metallic alloy in the second region.

The present inventors determined that the metallurgical bond that forms between the first region (including cemented hard particles) and the second region (including at least one of a metal and a metallic alloy) during sintering is surprisingly and unexpectedly strong. In various embodiments produced according to the present disclosure, the metallurgical bond between the first and second regions is free from significant defects, including cracks and brittle secondary phases. Such bond defects commonly are present when conventional techniques are used to bond a cemented hard particle material to a metal or metallic alloy. The metallurgical bond formed according to the present disclosure forms directly between the first and second regions at the microstructural level and is significantly stronger than bonds formed by prior art techniques used to bind together cemented carbides and metal or metallic alloys, such as, for example, the casting technique discussed in U.S. Pat. No. 5,359,772 to Carlsson. The method of Carlsson involving casting a molten iron onto cemented hard particles does not form a strong bond. Molten iron reacts with cemented carbides by chemically reacting with the tungsten carbide particles and forming a brittle phase commonly referred to as eta-phase. The interface is thus weak and brittle. The bond formed by the technique described in Carlsson is limited to the relatively weak bond that can be formed between a relatively low-melting molten cast iron and a preformed cemented carbide. Further, this technique only applies to cast iron as it relies on an austenite to bainite transition to relieve stress at the bond area.

The metallurgical bond formed by the present press and sinter technique using the materials recited herein avoids the stresses and cracking experienced with other bonding techniques. The strong bond formed according to the present disclosure effectively counteracts stresses resulting from differences in thermal expansion properties of the bonded materials, such that no cracks form in the interface between the first and second regions of the composite articles. This is believed to be at least partially a result of the nature of the unexpectedly strong metallurgical bond formed by the technique of the present disclosure, and also is a result of the compatibility of the materials discovered in the present technique. It has been discovered that not all metals and metallic alloys can be sintered to cemented hard particles such as cemented carbide.

In certain embodiments according to the present disclosure, the first region comprising cemented hard particles has a thickness greater than 100 microns. Also, in certain embodiments, the first region has a thickness greater than that of a coating.

In certain embodiments according to the present disclosure, the first and second regions each have a thickness greater than 100 microns. In certain other embodiments, each of the first and second regions has a thickness greater than 0.1 centimeters. In still other embodiments, the first and second regions each have a thickness greater than 0.5 centimeters. Certain other embodiments according to the present disclosure include first and second regions having a thickness of greater than 1 centimeter. Still other embodiments comprise first and second regions having a thickness greater than 5 centimeters. Also, in certain embodiments according to the present disclosure, at least the second region or another region of the composite sintered powder metal article has a thickness sufficient for the region to include mechanical attachment features such as, for example, threads or keyways, so that the composite article can be attached to another article via the mechanical attachment features.

The embodiments described herein achieve an unexpectedly and surprisingly strong metallurgical bond between the first region (including cemented hard particles) and the second region (including at least one of metal and a metallic alloy) of the composite article. In certain embodiments according to the present disclosure, the formation of the superior bond between the first and second regions is combined with incorporating advantageous mechanical features, such as threads or keyways, on the second region of the composite to provide a strong and durable composite article that may be used in a variety of applications or adapted for connection to other articles for use in specialized applications.

In other embodiments according to the present disclosure, a metal or metallic alloy of the second region has a thermal conductivity less than a thermal conductivity of the cemented hard particle material of the first region, wherein both thermal conductivities are evaluated at room temperature (20° C.). Without being limited to any specific theory, it is believed that the metal or metallic alloy of the second region must have a thermal conductivity that is less than a thermal conductivity of the cemented hard particle material of the first region in order to form a metallurgical bond between the first and second regions having sufficient strength for certain demanding applications of cemented hard particle materials. In certain embodiments, only metals or metallic alloys having thermal conductivity less than a cemented carbide may be used in the second region. In certain embodiments, the second region or any metal or metallic alloy of the second region has a thermal conductivity less than 100 W/mK. In other embodiments, the second region or any metal or metallic alloy of the second region may have a thermal conductivity less than 90 W/mK.

In certain other embodiments according to the present disclosure, the metal or metallic alloy of the second region of the composite article has a melting point greater than 1200° C. Without being limited to any specific theory, it is believed that the metal or metallic alloy of the second region must have a melting point greater than 1200° C. so as to form a metallurgical bond with the cemented hard particle material of the first region with bond strength sufficient for certain demanding applications of cemented hard particle materials. In other embodiments, the metal or metallic alloy of the second region of the composite article has a melting point greater than 1275° C. In some embodiments, the melting point of the metal or metallic alloy of the second region is greater than a cast iron.

According to the present disclosure, the cemented hard particle material included in the first region must include at least 60 percent by volume dispersed hard particles. If the cemented hard particle material includes less than 60 percent by volume of hard particles, the cemented hard particle material will lack the required combination of abrasion and wear resistance, strength, and fracture toughness needed for applications in which cemented hard particle materials are used. See Kenneth J. A. Brookes, Handbook of Hardmetals and Hard Materials (International Carbide Data, 1992). Accordingly, as used herein, "cemented hard particles" and "cemented hard particle material" refer to a composite material comprising a discontinuous phase of hard particles dispersed in a continuous binder material, and wherein the composite material includes at least 60 volume percent of the hard particle discontinuous phase.

In certain embodiments of the composite article according to the present disclosure, the metal or metallic alloy of the second region may include from 0 up to 50 volume percent of hard particles (based on the volume of the metal or metallic alloy). The presence of certain concentrations of such particles in the metal or metallic alloy may enhance wear resistance of the metal or alloy relative to the same material lacking such hard particles, but without significantly adversely affecting machineability of the metal or metallic alloy. Obviously, the presence of up to 50 volume percent of such particles in the metallic alloy does not result in a cemented hard particle material, as defined herein, for at least the reason that the hard particle volume fraction is significantly less than in a cemented hard particle material. In addition, it has been discovered that in certain composite articles according to the present disclosure, the presence of hard particles in the metal or metallic alloy of the second region may modify the shrinkage characteristics of the region so as to more closely approximate the shrinkage characteristics of the first region. In this way, the CTE of the second region may be adjusted to better ensure compatibility with the CTE of the first region to prevent formation of stresses in the metallurgical bond region that could result in cracking.

Thus, in certain embodiments according to the present disclosure, the metal or metallic alloy of the second region of the composite article includes from 0 up to 50 percent by volume, and preferably no more than 20 to 30 percent by volume hard particles dispersed in the metal or metallic alloy. The minimum amount of hard particles in the metal or metallic alloy region that would affect the wear resistance and/or shrinkage properties of the metal or metallic alloy is believed to be about 2 to 5 percent by volume. Thus, in certain embodiments according to the present disclosure, the metal or metallic alloy of the second region of the composite article includes from 2 to 50 percent by volume, and preferably from 2 to 30 percent by volume hard particles dispersed in the metal or metallic alloy. Other embodiments may include from 5 to 50 percent hard particles, or from 5 to 30 percent by volume hard particles dispersed in the metal or metallic alloy. Still other embodiments may comprise from 2 to 20, or from 5 to 20 percent by volume hard particles dispersed in the metal or metallic alloy. Certain other embodiments may comprise from 20 to 30 percent by volume hard particles by volume dispersed in the metal or metallic alloy.

The hard particles included in the first region and, optionally, the second region may be selected from, for example, the group consisting of a carbide, a nitride, a boride, a silicide, an oxide, and mixtures and solid solutions thereof. In one embodiment, the metal or metallic alloy of the second region includes up to 50 percent by volume of dispersed tungsten carbide particles.

In certain embodiments according to the present disclosure, the dispersed hard particle phase of the cemented hard particle material of the first region may include one or more hard particles selected from a carbide, a nitride, a boride, a silicide, an oxide, and solid solutions thereof. In certain embodiments, the hard particles may include carbide particles of at least one transition metal selected from titanium, chromium, vanadium, zirconium, hafnium, tantalum, molybdenum, niobium, and tungsten. In still other embodiments, the continuous binder phase of the cemented hard particle material of the first region includes at least one of cobalt, a cobalt alloy, nickel, a nickel alloy, iron, and an iron alloy. The binder also may include, for example, one or more elements selected from tungsten, chromium, titanium, tantalum, vanadium, molybdenum, niobium, zirconium, hafnium, and carbon, up to the solubility limits of these elements in the binder. Additionally, the binder may include up to 5 weight percent of one or more elements selected from copper, manganese, silver, aluminum, and ruthenium. One skilled in the art will recognize that any or all of the constituents of the cemented hard particle material may be introduced into the metallurgical powder from which the cemented hard particle material is formed in elemental form, as compounds, and/or as master alloys.

The properties of cemented hard particle materials, such as cemented carbides, depend on parameters including the average hard particle grain size and the weight fraction or volume fraction of the hard particles and/or binder. In general, the hardness and wear resistance increases as the grain size decreases and/or the binder content decreases. On the other hand, fracture toughness increases as the grain size increases and/or the binder content increases. Thus, there is a trade-off between wear resistance and fracture toughness when selecting a cemented hard particle material grade for any application. As wear resistance increases, fracture toughness typically decreases, and vice versa.

Certain other embodiments of the articles of the present disclosure include hard particles comprising carbide particles of at least one transition metal selected from titanium, chromium, vanadium, zirconium, hafnium, tantalum, molybdenum, niobium, and tungsten. In certain other embodiments, the hard particles include tungsten carbide particles. In still other embodiments, the tungsten carbide particles may have an average grain size of from 0.3 to 10 μm.

The hard particles of the cemented hard particle material in the first region preferably comprise from about 60 to about 98 volume percent of the total volume of the cemented hard particle material. The hard particles are dispersed within a matrix of a binder that preferably constitutes from about 2 to about 40 volume percent of the total volume of the cemented hard particle material.

Embodiments of the composite articles according to the present disclosure may also include hybrid cemented carbides such as, for example, any of the hybrid cemented carbides described in U.S. patent application Ser. No. 10/735,379, now U.S. Pat. No. 7,384,443, the entire disclosure of which is hereby incorporated herein by reference. For example, an article according to the present disclosure may comprise at least a first region including a hybrid cemented carbide metallurgically bonded to a second region comprising one of a metal and a metallic alloy. Certain other articles may comprise at least a first region including cemented hard particles, a second region including at least one of a metal and a metallic alloy, and a third region including a hybrid cemented carbide material, wherein the first and third regions are metallurgically bonded to the second region.

Generally, a hybrid cemented carbide is a material comprising particles of at least one cemented carbide grade dispersed throughout a second cemented carbide continuous phase, thereby forming a microscopic composite of cemented carbides. The hybrid cemented carbides of application Ser. No. 10/735,379 have low dispersed phase particle contiguity ratios and improved properties relative to certain other hybrid cemented carbides. Preferably, the contiguity ratio of the dispersed phase of a hybrid cemented carbide included in embodiments according to the present disclosure is less than or equal to 0.48. Also, a hybrid cemented carbide included in the embodiments according to the present disclosure preferably comprises a dispersed phase having a hardness greater than a hardness of the continuous phase of the hybrid cemented carbide. For example, in certain embodiments of hybrid cemented carbides included in one or more regions of the composite articles according to the present disclosure, the hardness of the dispersed phase in the hybrid cemented carbide is preferably greater than or equal to 88 Rockwell A Hardness (HRA) and less than or equal to 95 HRA, and the hardness of the continuous phase in the hybrid carbide is greater than or equal to 78 HRA and less than or equal to 91 HRA.

Additional embodiments of the articles according to the present disclosure may include hybrid cemented carbide in one or more regions of the articles wherein a volume fraction of the dispersed cemented carbide phase is less than 50 volume percent of the hybrid cemented carbide, and wherein the contiguity ratio of the dispersed cemented carbide phase is less than or equal to 1.5 times the volume fraction of the dispersed cemented carbide phase in the hybrid cemented carbide.

Certain embodiments of articles according to the present disclosure include a second region comprising at least one of a metal and a metallic alloy wherein the region includes at least one mechanical attachment feature or other mechanical feature. A mechanical attachment feature, as used herein, enables certain articles according to the present disclosure to be connected to certain other articles and function as part of a larger device. Mechanical attachment features may include, for example, threads, slots, keyways, teeth or cogs, steps, bevels, bores, pins, and arms. It has not previously been possible to successfully include such mechanical attachment features on articles formed solely from cemented hard particles for certain demanding applications because of the limited tensile strength and notch sensitivity of cemented hard particle materials. Prior art articles have included a metal or metallic alloy region including one or more mechanical attachment features that were coupled to a cemented hard particle region by means other than co-pressing and sintering. Such prior art articles suffered from a relatively weak bond between the metal or metallic alloy region and the cemented hard particle region, severely limiting the possible applications of the articles.

The process for manufacturing cemented hard particle parts typically comprises blending or mixing powdered ingredients including hard particles and a powdered binder to form a metallurgical powder blend. The metallurgical powder blend may be consolidated or pressed to form a green compact. The green compact is then sintered to form the article or a portion of the article. According to one process, the metallurgical powder blend is consolidated by mechanically or isostatically compressing to form the green compact, typically at pressures between 10,000 and 60,000 psi. In certain cases, the green compact may be pre-sintered at a temperature between about 400° C. and 1200° C. to form a "brown" compact. The green or brown compact is subsequently sintered to autogenously bond together the metallurgical powder particles and further densify the compact. In certain embodiments the powder compact may be sintered in vacuum or in hydrogen. In certain embodiments the compact is over pressure sintered at 300-2000 psi and at a temperature of 1350-1500° C. Subsequent to sintering, the article may be appropriately machined to form the desired shape or other features of the particular geometry of the article.

Embodiments of the present disclosure include methods of making a composite sintered powder metal composite article. One such method includes placing a first metallurgical powder into a first region of a void of a mold, wherein the first powder includes hard particles and a powdered binder. A second metallurgical powder blend is placed into a second region of the void of the mold. The second powder may include at least one of a metal powder and a metal alloy powder selected from the group consisting of a steel powder, a nickel powder, a nickel alloy powder, a molybdenum powder, a molybdenum alloy powder, a titanium powder, a titanium alloy powder, a cobalt powder, a cobalt alloy powder, a tungsten powder, and a tungsten alloy powder. The second powder may contact the first powder, or initially may be separated from the first powder in the mold by a separating means. Depending on the number of cemented hard particle and metal or metal alloy regions desired in the composite article, the mold may be partitioned into additional regions in which additional metallurgical powder blends may be disposed. For example, the mold may be segregated into regions by placing one or more physical partitions in the void of the mold to define the several regions and/or by merely filling regions of the mold with different powders without providing partitions between adjacent powders. The metallurgical powders are chosen to achieve the desired properties of the corresponding regions of the article as described herein. The materials used in the embodiments of the methods of this disclosure may comprise any of the materials discussed herein, but in powdered form, such that they can be pressed and sintered. Once the powders are loaded into the mold, any partitions are removed and the powders within the mold are then consolidated to form a green compact. The powders may be consolidated, for example, by mechanical or isostatic compression. The green compact may then be sintered to provide a composite sintered powder metal article including a cemented hard particle region formed from the first powder and metallurgically bonded to a second region formed from the second metal or metallic alloy powder. For example, sintering may be performed at a temperature suitable to autogenously bond the powder particles and suitably densify the article, such as at temperatures up to 1500° C.

The conventional methods of preparing a sintered powder metal article may be used to provide sintered articles of various shapes and including various geometric features. Such conventional methods will be readily known to those having ordinary skill in the art. Those persons, after considering the present disclosure, may readily adapt the conventional methods to produce composites articles according to the present disclosure.

A further embodiment of a method according to the present disclosure comprises consolidating a first metallurgical powder in a mold forming a first green compact and placing the first green compact in a second mold, wherein the first green compact fills a portion of the second mold. The second mold may be at least partially filled with a second metallurgical powder. The second metallurgical powder and the first green compact may be consolidated to form a second green compact. Finally, the second green compact is sintered to further densify the compact and to form a metallurgical bond between the region of the first metallurgical powder and the region of the second metallurgical powder. If necessary, the first green compact may be presintered up to a temperature of about 1200° C. to provide additional strength to the first green compact. Such embodiments of methods according to the present disclosure provide increased flexibility in design of the different regions of the composite article, for particular applications. The first green compact may be designed in any desired shape from any desired powder metal material according to the embodiments herein. In addition, the process may be repeated as many times as desired, preferably prior to sintering. For example, after consolidating to form the second green compact, the second green compact may be placed in a third mold with a third metallurgical powder and consolidated to form a third green compact. By such a repetitive process, more complex shapes may be formed. Articles including multiple clearly defined regions of differing properties may be formed. For example, a composite article of the present disclosure may include cemented hard particle materials where increased wear resistance properties, for example, are desired, and a metal or metallic alloy in article regions at which it is desired to provide mechanical attachment features.

Certain embodiments of the methods according to the present disclosure are directed to composite sintered powder metal articles. As used herein, a composite article is an object that comprises at least two regions, each region composed of a different material. Composite sintered powder metal articles according to the present disclosure include at least a first region, which includes cemented hard particles, metallurgically bonded to a second region, which includes at least one of a metal and a metallic alloy. Two non-limiting examples of composite articles according to the present disclosure are shown in FIG. 1A. Sintered powder metal article 100 includes a first region in the form of cemented carbide region 110 metallurgically bonded to a nickel region 112. Sintered powder metal article 200 includes a first region in the form of a cemented carbide region 210 metallurgically bonded to a second region in the form of a threaded nickel region 212.

In composite articles according to the present disclosure, the cemented hard particles of the first region are a composite including a discontinuous phase of hard particles dispersed in a continuous binder phase. The metal and/or metallic alloy included in the second region is one or more selected from a steel, nickel, a nickel alloy, titanium, a titanium alloy, molybdenum, a molybdenum alloy, cobalt, a cobalt alloy, tungsten, and a tungsten alloy. The two regions are formed from metallurgical powders that are pressed and sintered together. During sintering, a metallurgical bond forms between the first and second regions, for example, at the interface between the cemented hard particles in the first region and the metal or metallic alloy in the second region.

In the embodiments of the methods of the present disclosure, the present inventors determined that the metallurgical bond that forms between the first region (including cemented hard particles) and the second region (including at least one of a metal and a metallic alloy) during sintering is surprisingly and unexpectedly strong. In various embodiments produced according to the present disclosure, the metallurgical bond between the first and second regions is free from significant defects, including cracks. Such bond defects commonly are present when conventional techniques are used to bond a cemented hard particle material to a metal or metallic alloy. The metallurgical bond formed according to the present disclosure forms directly between the first and second regions at the microstructural level and is significantly stronger than bonds formed by prior art techniques used to bind together cemented carbides and metal or metallic alloys, such as the casting technique discussed in U.S. Pat. No. 5,359,772 to Carlsson, which is described above. The metallurgical bond formed by the press and sinter technique using the materials recited herein avoids the stresses and cracking experienced with other bonding techniques. This is believed to be at least partially a result of the nature of the strong metallurgical bond formed by the technique of the present disclosure, and also is a result of the compatibility of the materials used in the present technique. It has been discovered that not all metals and metallic alloys can be sintered to cemented hard particles such as cemented carbide. Also, the strong bond formed according to the present disclosure effectively counteracts stresses resulting from differences in thermal expansion properties of the bonded materials, such that no cracks form in the interface between the first and second regions of the composite articles.

In certain embodiments of the methods according to the present disclosure, the first region comprising cemented hard particles has a thickness greater than 100 microns. Also, in certain embodiments, the first region has a thickness greater than that of a coating.

The embodiments of the methods described herein achieve an unexpectedly and surprisingly strong metallurgical bond between the first region (including cemented hard particles) and the second region (including at least one of metal and a metallic alloy) of the composite article. In certain embodiments of the methods according to the present disclosure, the formation of the superior bond between the first and second regions is combined with the step of incorporating advantageous mechanical features, such as threads or keyways, on the second region of the composite to provide a strong and durable composite article that may be used in a variety of applications or adapted for connection to other articles for use in specialized applications.

In certain embodiments of the methods according to the present disclosure, the first and second regions each have a thickness greater than 100 microns. In certain other embodiments, each of the first and second regions has a thickness greater than 0.1 centimeters. In still other embodiments, the first and second regions each have a thickness greater than 0.5 centimeters. Certain other embodiments according to the present disclosure include first and second regions having a thickness of greater than 1 centimeter. Still other embodiments comprise first and second regions having a thickness greater than 5 centimeters. Also, in certain embodiments of the methods according to the present disclosure, at least the second region or another region of the composite sintered powder metal article has a thickness sufficient for the region to include mechanical attachment features such as, for example, threads or keyways, so that the composite article can be attached to another article via the mechanical attachment features.

In other embodiments according to the methods of the present disclosure, a metal or metallic alloy of the second region has a thermal conductivity less than a thermal conductivity of the cemented hard particle material of the first region, wherein both thermal conductivities are evaluated at room temperature (20° C.). Without being limited to any specific theory, it is believed that the metal or metallic alloy of the second region must have a thermal conductivity that is less than a thermal conductivity of the cemented hard particle material of the first region in order to form a metallurgical bond between the first and second regions having sufficient strength for certain demanding applications of cemented hard particle materials. In certain embodiments, only metals or metallic alloys having thermal conductivity less than a cemented carbide may be used in the second region. In certain embodiments, the second region or any metal or metallic alloy of the second region has a thermal conductivity less than 100 W/mK. In other embodiments, the second region or any metal or metallic alloy of the second region may have a thermal conductivity less than 90 W/mK.

In certain other embodiments of the methods according to the present disclosure, the metal or metallic alloy of the second region of the composite article has a melting point greater than 1200° C. Without being limited to any specific theory, it is believed that the metal or metallic alloy of the second region must have a melting point greater than 1200° C. so as to form a metallurgical bond with the cemented hard particle material of the first region with bond strength sufficient for certain demanding applications of cemented hard particle materials. In other embodiments, the metal or metallic alloy of the second region of the composite article has a melting point greater than 1275° C. In some embodiments, the melting point of the metal or metallic alloy of the second region is greater than a cast iron.

According to the present disclosure, the cemented hard particle material included in the first region must include at least 60 percent by volume dispersed hard particles. If the cemented hard particle material includes less than 60 percent by volume of hard particles, the cemented hard particle material will lack the required combination of abrasion and wear resistance, strength, and fracture toughness needed for applications in which cemented hard particle materials are used. Accordingly, as used herein, "cemented hard particles" and "cemented hard particle material" refer to a composite material comprising a discontinuous phase of hard particles dispersed in a continuous binder material, and wherein the composite material includes at least 60 volume percent of the hard particle discontinuous phase.

In certain embodiments of the methods of making the composite articles according to the present disclosure, the metal or metallic alloy of the second region may include from 0 up to 50 volume percent of hard particles (based on the volume of the metal or metallic alloy). The presence of certain concentrations of such particles in the metal or metallic alloy may enhance wear resistance of the metal or alloy relative to the same material lacking such hard particles, but without significantly adversely affecting machineability of the metal or metallic alloy. Obviously, the presence of up to 50 volume percent of such particles in the metallic alloy does not result in a cemented hard particle material, as defined herein, for at least the reason that the hard particle volume fraction is significantly less than in a cemented hard particle material. In addition, it has been discovered that in certain composite articles according to the present disclosure, the presence of hard particles in the metal or metallic alloy of the second region may modify the shrinkage characteristics of the region so as to more closely approximate the shrinkage characteristics of the first region. In this way, the CTE of the second region may be adjusted to better ensure compatibility with the CTE of the first region to prevent formation of stresses in the metallurgical bond region that could result in cracking.

Thus, in certain embodiments of the methods according to the present disclosure, the metal or metallic alloy of the second region of the composite article includes from 0 up to 50 percent by volume, and preferably no more than 20 to 30 percent by volume, hard particles dispersed in the metal or metallic alloy. The minimum amount of hard particles in the metal or metallic alloy region that would affect the wear resistance and/or shrinkage properties of the metal or metallic alloy is believed to be about 2 to 5 percent by volume. Thus, in certain embodiments according to the present disclosure, the metallic alloy of the second region of the composite article includes from 2 to 50 percent by volume, and preferably from 2 to 30 percent by volume hard particles dispersed in the metal or metallic alloy. Other embodiments may include from 5 to 50 percent hard particles, or from 5 to 30 percent by volume hard particles dispersed in the metal or metallic alloy. Still other embodiments may comprise from 2 to 20, or from 5 to 20 percent by volume hard particles dispersed in the metal or metallic alloy. Certain other embodiments may comprise from 20 to 30 percent by volume hard particles dispersed in the metal or metallic alloy.

The hard particles included in the first region and, optionally, the second region may be selected from, for example, the group consisting of a carbide, a nitride, a boride, a silicide, an oxide, and mixtures and solid solutions thereof. In one embodiment, the metal or metallic alloy of the second region includes up to 50 percent by volume of dispersed tungsten carbide particles.

In certain embodiments of the methods according to the present disclosure, the dispersed hard particle phase of the cemented hard particle material of the first region may include one or more hard particles selected from a carbide, a nitride, a boride, a silicide, an oxide, and solid solutions thereof. In certain embodiments, the hard particles may include carbide particles of at least one transition metal selected from titanium, chromium, vanadium, zirconium, hafnium, tantalum, molybdenum, niobium, and tungsten. In still other embodiments, the continuous binder phase of the cemented hard particle material of the first region includes at least one of cobalt, a cobalt alloy, nickel, a nickel alloy, iron, and an iron alloy. The binder also may include, for example, one or more elements selected from tungsten, chromium, titanium, tantalum, vanadium, molybdenum, niobium, zirconium, hafnium, and carbon, up to the solubility limits of these elements in the binder. Additionally, the binder may include up to 5 weight percent of one of more elements selected from copper, manganese, silver, aluminum, and ruthenium. One skilled in the art will recognize that any or all of the constituents of the cemented hard particle material may be introduced into the metallurgical powder from which the cemented hard particle material is formed in elemental form, as compounds, and/or as master alloys.

The properties of cemented hard particle materials, such as cemented carbides, depend on parameters including the average hard particle grain size and the weight fraction or volume fraction of the hard particles and/or binder. In general, the hardness and wear resistance increases as the grain size decreases and/or the binder content decreases. On the other hand, fracture toughness increases as the grain size increases and/or the binder content increases. Thus, there is a trade-off between wear resistance and fracture toughness when selecting a cemented hard particle material grade for any application. As wear resistance increases, fracture toughness typically decreases, and vice versa.

Certain other embodiments of the methods to make the articles of the present disclosure include hard particles comprising carbide particles of at least one transition metal selected from titanium, chromium, vanadium, zirconium, hafnium, tantalum, molybdenum, niobium, and tungsten. In certain other embodiments, the hard particles include tungsten carbide particles. In still other embodiments, the tungsten carbide particles may have an average grain size of from 0.3 to 10 μm.

The hard particles of the cemented hard particle material in the first region preferably comprise from about 60 to about 98 volume percent of the total volume of the cemented hard particle material. The hard particles are dispersed within a matrix of a binder that preferably constitutes from about 2 to about 40 volume percent of the total volume of the cemented hard particle material.

Embodiments of the methods to make the composite articles according to the present disclosure may also include hybrid cemented carbides such as, for example, any of the hybrid cemented carbides described in copending U.S. patent application Ser. No. 10/735,379, the entire disclosure of which is hereby incorporated herein by reference. For example, an article according to the present disclosure may comprise at least a first region including hybrid cemented carbide metallurgically bonded to a second region comprising one of a metal and a metallic alloy. Certain other articles may comprise at least a first region including cemented hard particles, a second region including at least one of a metal and a metallic alloy, and a third region including a hybrid cemented carbide material, wherein the first and third regions are metallurgically bonded to the second region.

Generally, a hybrid cemented carbide is a material comprising particles of at least one cemented carbide grade dispersed throughout a second cemented carbide continuous phase, thereby forming a microscopic composite of cemented carbides. The hybrid cemented of application Ser. No. 10/735,379 have low dispersed phase particle contiguity ratios and improved properties relative to certain other hybrid cemented carbides. Preferably, the contiguity ratio of the dispersed phase of a hybrid cemented carbide included in embodiments according to the present disclosure is less than or equal to 0.48. Also, a hybrid cemented carbide included in the embodiments according to the present disclosure preferably comprises a dispersed phase having a hardness greater than a hardness of the continuous phase of the hybrid cemented carbide. For example, in certain embodiments of hybrid cemented carbides included in one or more regions of the composite articles according to the present disclosure, the hardness of the dispersed phase in the hybrid cemented carbide is preferably greater than or equal to 88 Rockwell A Hardness (HRA) and less than or equal to 95 HRA, and the hardness of the continuous phase in the hybrid carbide is greater than or equal to 78 HRA and less than or equal to 91 HRA.

Additional embodiments of the methods to make the articles according to the present disclosure may include hybrid cemented carbide in one or more regions of the articles wherein a volume fraction of the dispersed cemented carbide phase is less than 50 volume percent of the hybrid cemented carbide, and wherein the contiguity ratio of the dispersed cemented carbide phase is less than or equal to 1.5 times the volume fraction of the dispersed cemented carbide phase in the hybrid cemented carbide.

Certain embodiments of the methods to make the articles according to the present disclosure include forming a mechanical attachment feature or other mechanical feature on at least the second region comprising at least one of a metal and a metallic alloy. A mechanical attachment feature, as used herein, enables certain articles according to the present disclosure to be connected to certain other articles and function as part of a larger device. Mechanical attachment features may include, for example, threads, slots, keyways, teeth or cogs, steps, bevels, bores, pins, and arms. It has not previously been possible to successfully include such mechanical attachment features on articles formed solely from cemented hard particles for certain demanding applications because of the limited tensile strength and notch sensitivity of cemented hard particle materials. Prior art articles have included a metal or metallic alloy region including one or more mechanical attachment features that were attached by means other than co-pressing and sintering to a cemented hard particle region. Such prior art articles suffered from a relatively weak bond between the metal or metallic alloy region and the cemented hard particle region, severely limiting the possible applications of the articles.

EXAMPLE 1

Figure 1B:
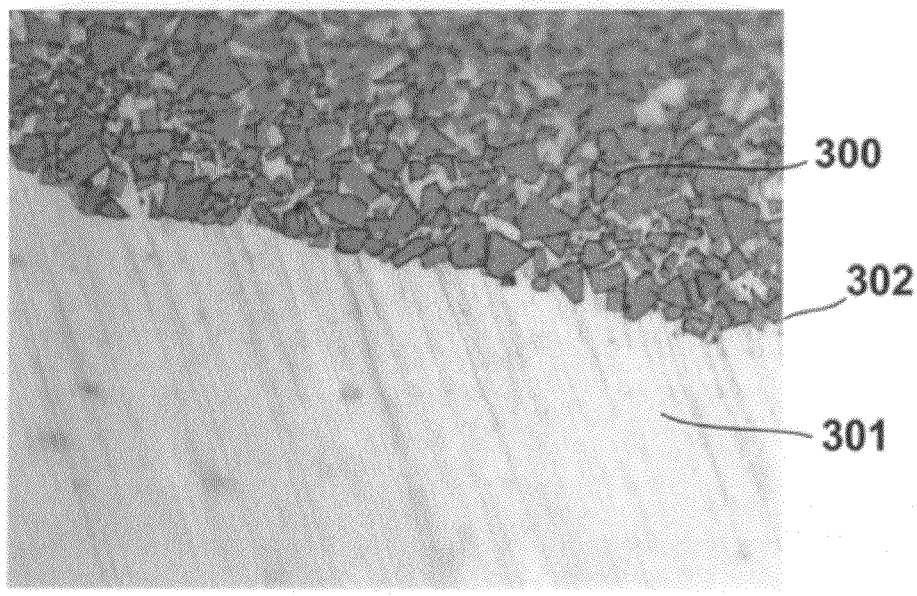
FIG. 1B is a photomicrograph of a cross-section of the metallurgical bond region of one non-limiting embodiment of a cemented carbide-nickel composite article according to the present disclosure.

FIG. 1A shows cemented carbide-metallic composite articles 100, 200 consisting of a cemented carbide portion 110, 210 metallurgically bonded to a nickel portion 112, 212 that were fabricated using the following method according to the present disclosure. A layer of cemented carbide powder (available commercially as FL30™ powder, from ATI Firth Sterling, Madison, Ala., USA) consisting of 70% tungsten carbide, 18% cobalt, and 12% nickel was placed in a mold in contact with a layer of nickel powder (available commercially as Inco Type 123 high purity nickel from Inco Special Products, Wyckoff, N.J., USA) and co-pressed to form a single green compact consisting of two distinct layers of consolidated powder materials. The pressing (or consolidation) was performed in a 100 ton hydraulic press employing a pressing pressure of approximately 20,000 psi. The resulting green compact was a cylinder approximately 1.5 inches in diameter and approximately 2 inches long. The cemented carbide layer was approximately 0.7 inches long, and the nickel layer was approximately 1.3 inches long. Following pressing, the composite compact was sintered in a vacuum furnace at 1380° C. During sintering the compact's linear shrinkage was approximately 18% along any direction. The composite sintered articles were ground on the outside diameter, and threads were machined in the nickel portion 212 of one of the articles. FIG. 1B is a photomicrograph showing the microstructure of articles 100 and 200 at the interface of the cemented carbide material 300 and nickel material 301. FIG. 1B clearly shows the cemented carbide and nickel portions metallurgically bonded together at interface region 302. No cracks were apparent in the interface region.

EXAMPLE 2

Figure 2:
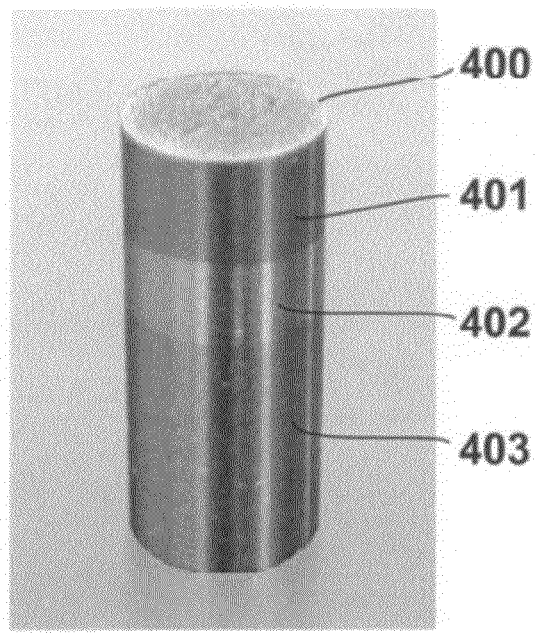
FIG. 2 illustrates one non-limiting embodiment of a three-layer composite sintered powder metal article according to the present disclosure, wherein the composite includes a cemented carbide region, a nickel region, and a steel region.

FIG. 2 shows a cemented carbide-metallic alloy composite article 400 that was fabricated by powder metal pressing and sintering techniques according to the present disclosure and included three separate layers. The first layer 401 consisted of cemented carbide formed from FL30™ (see above). The second layer 402 consisted of nickel formed from nickel powder, and the third layer 403 consisted of steel formed from a steel powder. The method employed for fabricating the composite was essentially identical to the method employed in Example 1 except that three layers of powders were co-pressed together to form the green compact, instead of two layers. The three layers appeared uniformly metallurgically bonded together to form the composite article. No cracks were apparent on the exterior of the sintered article in the vicinity of the interface between the cemented carbide and nickel regions.

EXAMPLE 3

Figure 3:
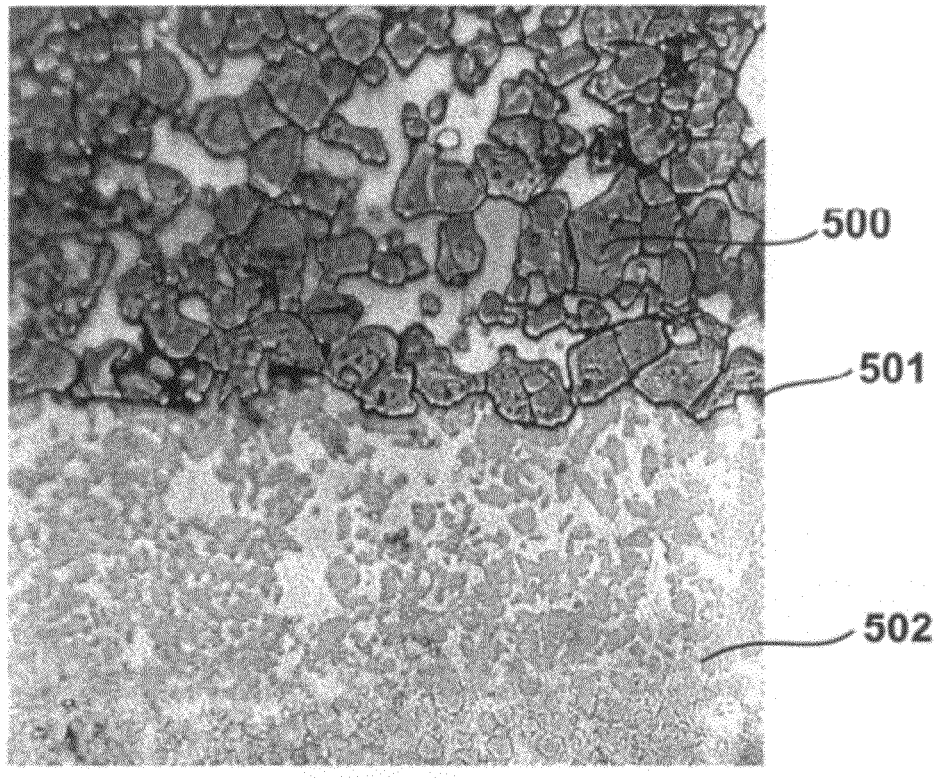
FIG. 3 is a photomicrograph of a cross-section of a region of a composite sintered powder metal article according to the present disclosure, wherein the composite includes a cemented carbide region and a tungsten alloy region, and wherein the figure depicts the metallurgical bond region of the composite. The grains visible in the tungsten alloy portion are grains of pure tungsten. The grains visible in the cemented carbide region are grains of cemented carbide.

A composite article consisting of a cemented carbide portion and a tungsten alloy portion was fabricated according to the present disclosure using the following method. A layer of cemented carbide powder (FL30™ powder) was disposed in a mold in contact with a layer of tungsten alloy powder (consisting of 70% tungsten, 24% nickel, and 6% copper) and co-pressed to form a single composite green compact consisting of two distinct layers of consolidated powders. The pressing (or consolidation) was performed in a 100 ton hydraulic press employing a pressing pressure of approximately 20,000 psi. The green compact was a cylinder approximately 1.5 inches in diameter and approximately 2 inches long. The cemented carbide layer was approximately 1.0 inches long and the tungsten alloy layer was also approximately 1.0 inches long. Following pressing, the composite compact was sintered at 1400° C. in hydrogen, which minimizes or eliminates oxidation when sintering tungsten alloys. During sintering, the compact's linear shrinkage was approximately 18% along any direction. FIG. 3 illustrates the microstructure which clearly shows the cemented carbide 502 and tungsten alloy 500 portions metallurgically bonded together at the interface 501. No cracking was apparent in the interface region.

Although the foregoing description has necessarily presented only a limited number of embodiments, those of ordinary skill in the relevant art will appreciate that various changes in the subject matter and other details of the examples that have been described and illustrated herein may be made by those skilled in the art, and all such modifications will remain within the principle and scope of the present disclosure as expressed herein and in the appended claims. For example, although the present disclosure has necessarily only presented a limited number of embodiments of rotary burrs constructed according to the present disclosure, it will be understood that the present disclosure and associated claims are not so limited. Those having ordinary skill will readily identify additional rotary burr designs and may design and build additional rotary burrs along the lines and within the spirit of the necessarily limited number of embodiments discussed herein. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

What is claimed is:

1. A composite sintered powder metal article, comprising:

a first region comprising at least 60 percent by volume cemented hard particles; and a second region comprising one of a metal and a metallic alloy selected from a steel, nickel, a nickel alloy, titanium, a titanium alloy, molybdenum, a molybdenum alloy, cobalt, a cobalt alloy, tungsten, and a tungsten alloy, and from 0 up to 30 percent by volume of hard particles;

wherein the first region is metallurgically bonded to the second region and each of the first region and the second region has a thickness greater than 100 microns.

2. The composite sintered powder metal article of claim 1, wherein the metal or metallic alloy of the second region has a thermal conductivity less than a thermal conductivity of the cemented hard particles.

3. The composite sintered powder metal article of claim 2, wherein the metal or metallic alloy of the second region has a thermal conductivity less than 100 W/mK.

4. The composite sintered powder metal article of claim 1, wherein the metal or metallic alloy of the second region has a melting point greater than 1200° C.

5. The composite sintered powder metal article of claim 1, wherein the metal or metallic alloy of the second region comprises up to 30 percent by volume of one or more hard particles selected from a carbide, a nitride, a boride, a silicide, an oxide, and solid solutions thereof.

6. The composite sintered powder metal article of claim 1, wherein the second region comprises up to 30 percent by volume of tungsten carbide particles.

7. The composite sintered powder metal article of claim 1, wherein the cemented hard particles comprise hard particles dispersed in a continuous binder phase.

8. The composite sintered powder metal article of claim 7, wherein the hard particles comprise one or more particles selected from a carbide, a nitride, a boride, a silicide, an oxide, and solid solutions thereof, and the binder phase comprises at least one of cobalt, a cobalt alloy, molybdenum, a molybdenum alloy, nickel, a nickel alloy, iron, and an iron alloy.

9. The composite sintered powder metal article of claim 7, wherein the hard particles comprise carbide particles of at least one transition metal selected from titanium, chromium, vanadium, zirconium, hafnium, tantalum, molybdenum, niobium, and tungsten.

10. The composite sintered powder metal article of claim 7, wherein the binder phase comprises cobalt.

11. The composite sintered powder metal article of claim 1, wherein the cemented hard particles comprise tungsten carbide particles.

12. The composite sintered powder metal article of claim 11, wherein the tungsten carbide particles have an average grain size of 0.3 to 10 μm.

13. The composite sintered powder metal article of claim 1, wherein the cemented hard particles comprise from 2 to 40 volume percent of a continuous binder phase and from 60 to 98 volume percent of hard particles dispersed in the continuous binder phase.

14. The composite sintered powder metal article of claim 1, wherein the cemented hard particles comprise particles of a hybrid cemented carbide.

15. The composite sintered powder metal article of claim 14, wherein the hybrid cemented carbide particles comprise:

a cemented carbide continuous phase; and a cemented carbide dispersed phase dispersed in the cemented carbide continuous phase, wherein the contiguity ratio of the cemented carbide dispersed phase in the hybrid cemented carbide particles is less than or equal to 0.48.

16. The composite sintered powder metal article of claim 14, wherein a volume fraction of the cemented carbide dispersed phase in the hybrid cemented carbide particles is less than 50 volume percent and a contiguity ratio of the cemented carbide dispersed phase in the hybrid cemented carbide phase is less than or equal to 1.5 times a volume fraction of the dispersed phase in the hybrid cemented carbide particles.

* * * * *